US008764468B1

(12) United States Patent
Feroli et al.

(10) Patent No.: US 8,764,468 B1
(45) Date of Patent: Jul. 1, 2014

(54) ADAPTIVE CONNECTOR ASSEMBLY

(75) Inventors: Lawrence J. Feroli, West Townsend, MA (US); Joseph P. King, Jr., Sterling, MA (US)

(73) Assignee: EMC Corporation, Hopkinton, MA (US)

( * ) Notice: Subject to any disclaimer, the term of this patent is extended or adjusted under 35 U.S.C. 154(b) by 159 days.

(21) Appl. No.: 13/436,919

(22) Filed: Mar. 31, 2012

(51) Int. Cl.
*H01R 13/64* (2006.01)

(52) U.S. Cl.
USPC ..... 439/248; 439/378

(58) Field of Classification Search
USPC ..... 439/247, 248, 378
See application file for complete search history.

(56) References Cited

U.S. PATENT DOCUMENTS 3,133,776 A * 5/1964 Magers et al. ..... 439/248
4,944,568 A * 7/1990 Danbach et al. ..... 385/88
4,998,892 A * 3/1991 Shiley ..... 439/381
5,752,845 A * 5/1998 Fu ..... 439/247
5,795,177 A * 8/1998 Hirono ..... 439/378
5,912,799 A * 6/1999 Grouell et al. ..... 361/679.32
5,993,241 A * 11/1999 Olson et al. ..... 439/378
6,142,814 A * 11/2000 Wu et al. ..... 439/378
6,527,572 B2 * 3/2003 Jou ..... 439/248
7,458,837 B2 * 12/2008 Mineo ..... 439/248
7,922,510 B2 * 4/2011 Klinger et al. ..... 439/247
8,360,796 B2 * 1/2013 Daubigney ..... 439/345
8,366,468 B2 * 2/2013 Carnevali ..... 439/248

* cited by examiner

*Primary Examiner* — Thanh Tam Le

(74) *Attorney, Agent, or Firm* — Brian J. Colandreo; Mark H. Whittenberger; Holland & Knight LLP

(57) ABSTRACT

An adaptive connector assembly may include two or more conductors and at least one compliance member configured to allow for three dimensional movement of the two or more conductors with respect to a frame assembly. The frame assembly may be configured to be mounted within an information technology (IT) cabinet.

18 Claims, 7 Drawing Sheets

ADAPTIVE CONNECTOR ASSEMBLY

TECHNICAL FIELD

This disclosure relates to power connectors and, more particularly, to displaceable power connectors.

BACKGROUND

In today's IT infrastructure, high availability is of paramount importance. Specifically, critical (and sometimes non-critical) components within an IT infrastructure are often layered in redundancy. For example, primary servers may be supported by backup servers; primary switches may be supported by backup switches; primary power supplies may be supported by backup power supplies; and primary storage systems may be supported by backup storage systems.

Oftentimes, various IT components are configured to be quickly inserted into and removed from various rack enclosures. Accordingly, hard drive modules, power supply modules, and computing modules may be configured to be quickly placed into and removed from frame assemblies. Accordingly, these frame assemblies (and the modules that mate with them) must include the appropriate electrical connections so that when the modules are installed into the frame assemblies, all of the required electrical connections are made for the device to function properly.

SUMMARY OF DISCLOSURE

In a first implementation, an adaptive connector assembly includes two or more conductors and at least one compliance member configured to allow for three dimensional movement of the two or more conductors with respect to a frame assembly.

One or more of the following features may be included. The frame assembly may be configured to be mounted within an IT cabinet. The frame assembly may be configured to removeably couple a module assembly. The module assembly may be an IT module assembly. The two or more conductors may include pin connectors. The pin connectors may include at least one tapered end. The at least one compliance may include a fastener assembly and a spring assembly. The two or more conductors may be attached to a backplane. The fastener assembly may be configured to pass through the backplane assembly. One or more energy absorption assemblies may be attached to the frame assembly and configured to contact a module assembly when the module assembly is removeably coupled to the frame assembly.

In another implementation, an adaptive connector assembly includes two or more conductors attached to a backplane and at least one compliance member configured to allow for three dimensional movement of the two or more conductors with respect to a frame assembly. The two or more conductors include pin connectors.

One or more of the following features may be included. The frame assembly may be configured to removeably couple a module assembly. The module assembly may be an IT module assembly. The pin connectors may include at least one tapered end. The at least one compliance may include a fastener assembly and a spring assembly. The fastener assembly may be configured to pass through the backplane assembly.

In another implementation, an adaptive connector assembly includes two or more conductors attached to a backplane, wherein the two or more conductors include pin connectors. Two or more compliance members are configured to allow for three dimensional movement of the backplane with respect to a frame assembly. The two or more compliance include a fastener assembly and a spring assembly.

One or more of the following features may be included. The pin connectors may include at least one tapered end. The fastener assembly may be configured to pass through the backplane assembly. One or more energy absorption assemblies may be attached to the frame assembly and configured to contact a module assembly when the module assembly is removeably coupled to the frame assembly.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1:
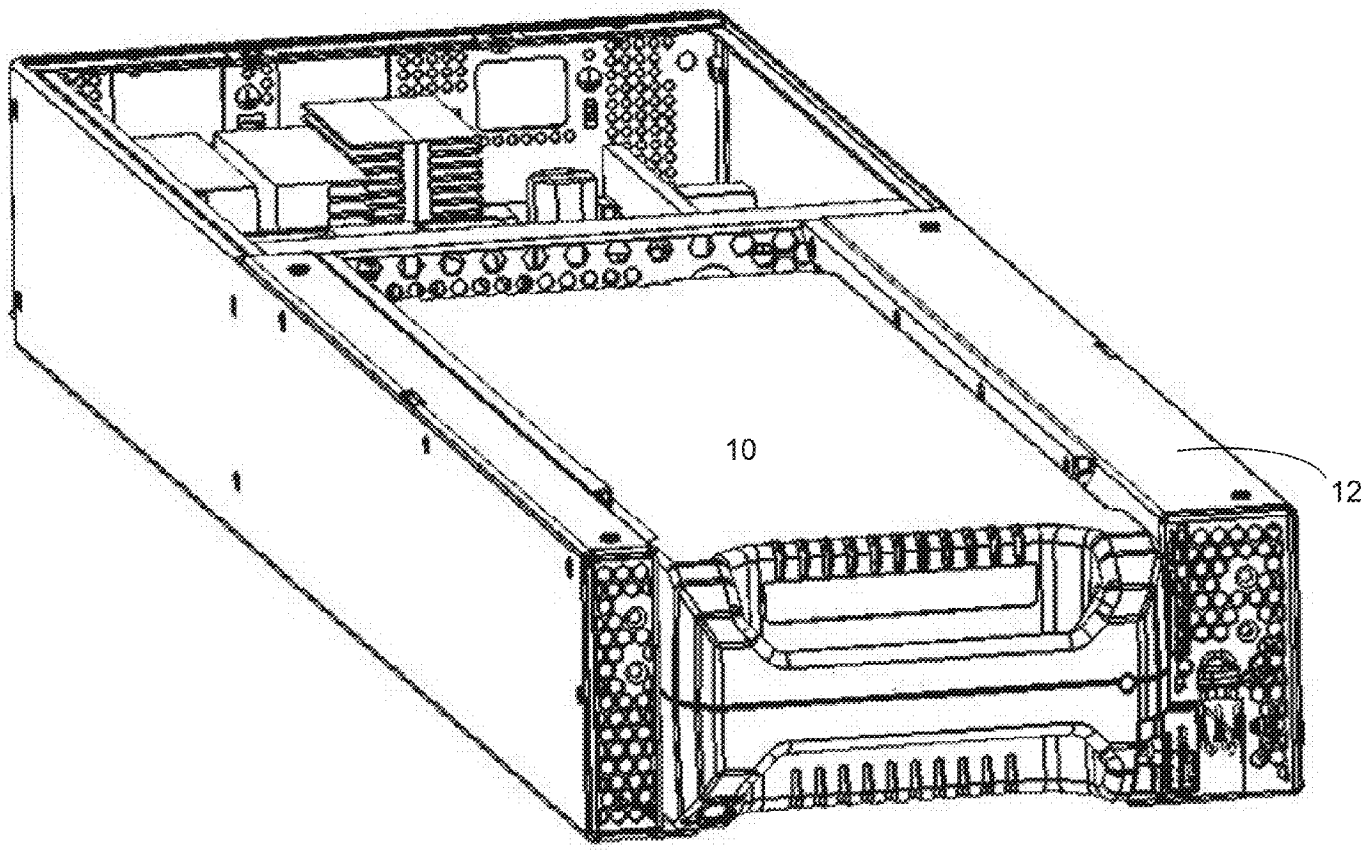
FIGS. 1-2 are diagrammatic views of a module assembly inserted into a frame assembly.
Figure 2:
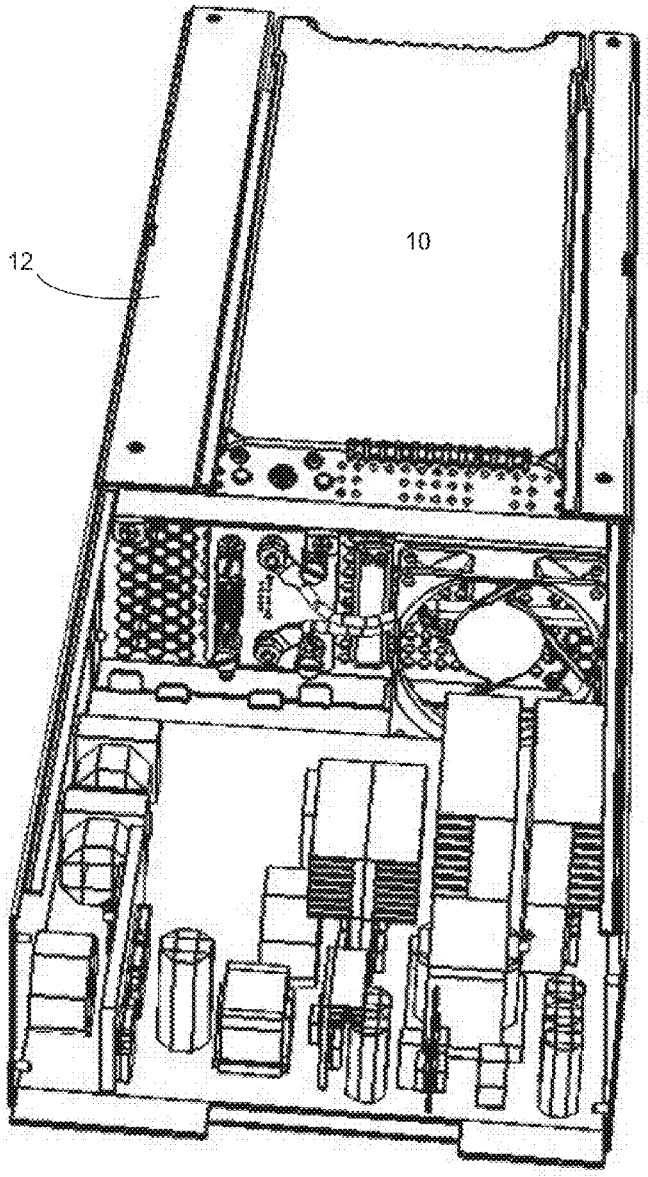

Referring to FIGS. 1-2, there is shown module assembly 10 and frame assembly 12, wherein module assembly 10 is removably positionable within frame assembly 12. Examples of frame assembly 12 may include but are not limited to frame assemblies that are capable of being mounted into IT cabinetry (e.g. racks, cabinets, enclosures). Examples of module assembly 10 may include but are not limited to various IT componentry that would be removably positionable within frame assembly 12, such as hard disk drive module assemblies, processing module assemblies, power supply module assemblies, and controller module assemblies.

Accordingly, frame assembly 12 may be configured as a power supply and module assembly 10 may include a battery assembly and be configured to be removably coupleable to frame assembly 12. Alternatively, frame assembly 12 may be a storage subsystem and module assembly 10 may include a hard disk drive and be configured to be removably coupleable to frame assembly 12.

As module assembly 10 is configured to be repeatedly inserted into and removed from frame assembly 12, frame assembly 12 may include a robust electrical connector assembly that may allow for automated alignment of the electrical connectors that couple frame assembly 12 and module assembly 10.

Figure 3:
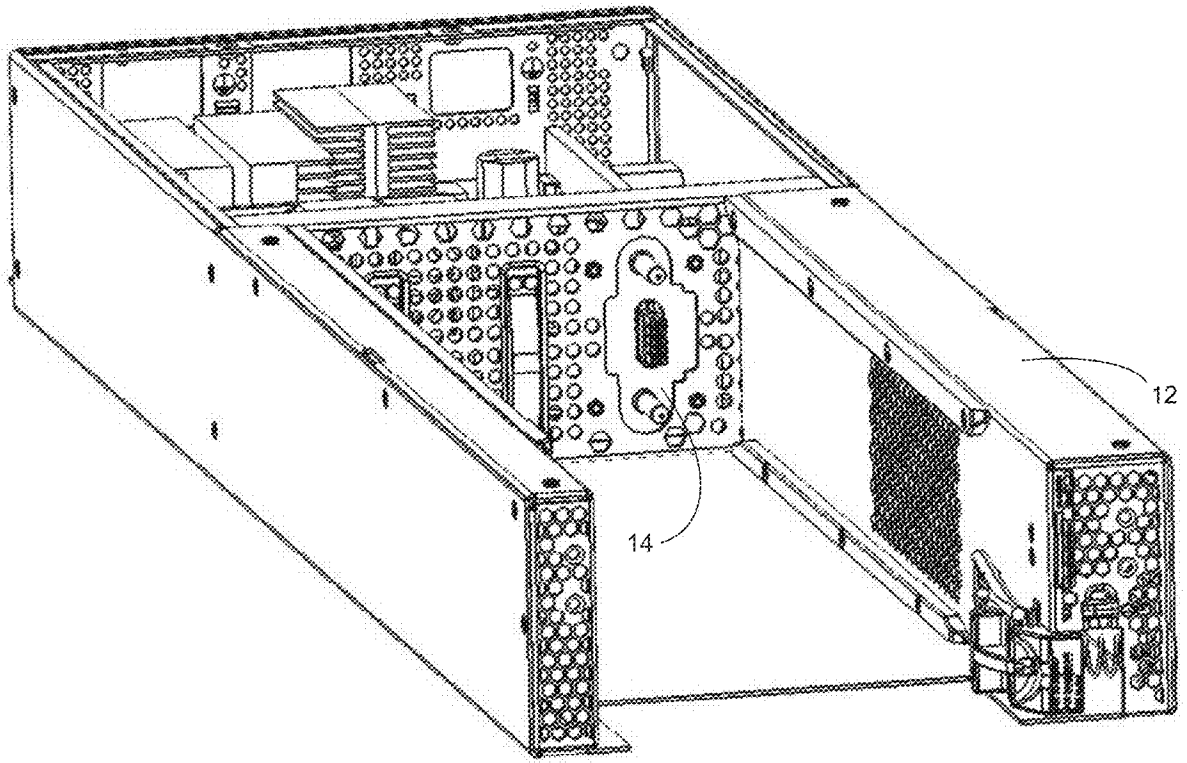
FIGS. 3-4 are diagrammatic views of an adaptive connector assembly.
Figure 4:
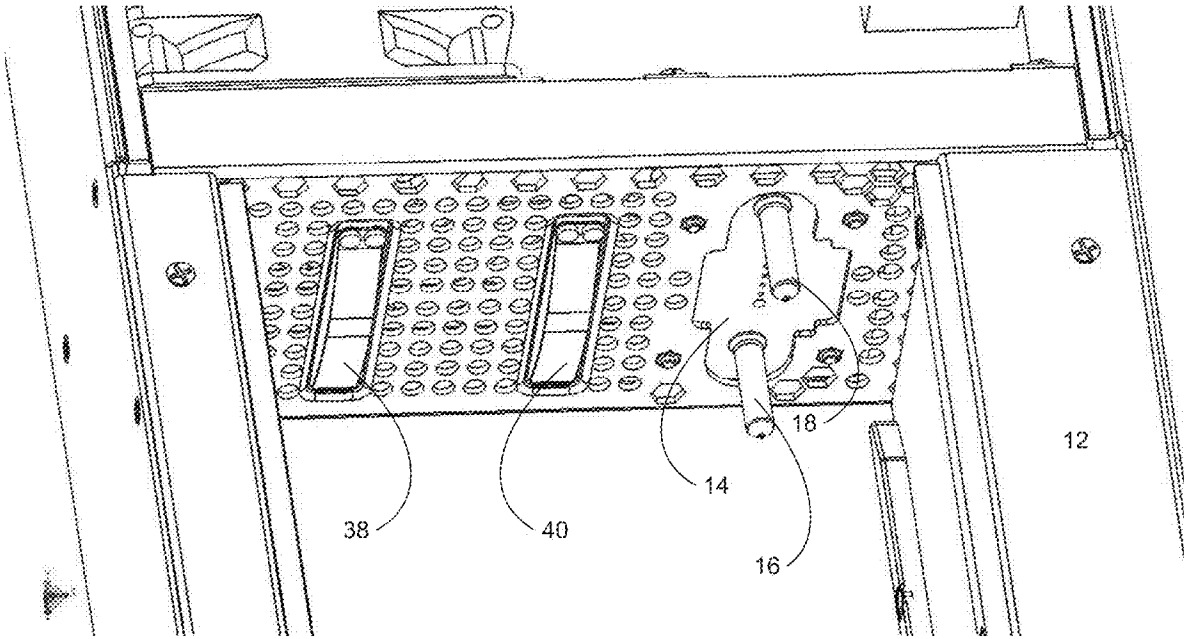

Referring also to FIG. 3-4, there is shown adaptive connector assembly 14 that is included within (in this embodiment) frame assembly 12. Alternatively, adaptive connector assembly 14 may be included within module assembly 10. In this particular embodiment of adaptive connector assembly 14, adaptive connector assembly 14 is shown to include two electrical connectors, namely pin connectors 16, 18. The ends of pin connectors 16, 18 maybe be tapered to aid in aligning pin connectors 16, 18 with corresponding female connectors (not shown) on module assembly 10. A typical embodiment of pin connectors 16, 18 would be that of a ground connector and a DC voltage connector. For example, pin connector 16 may be configured to provide a ground connection to module assembly 10 and pin connector 18 may be configured to provide a 12 VDC electrical connection to module assembly 10.

While in this particular example, adaptive connector assembly 14 is shown to include only two electrical connections (namely pin connectors 16, 18), this is for illustrative purposes only and is not intended to be a limitation of this disclosure. For example, additional electrical connectors may be included to provide e.g. data coupling functionality between frame assembly 12 and module assembly 10.

In order to allow module assembly 10 to slide into frame assembly 12, there should be some clearance between frame assembly 12 and module assembly 10. Accordingly, module assembly 10 should be a little bit smaller than frame assembly 12 or frame assembly 12 should be a little bit bigger than module assembly 10. Such clearance may be required in order to allow module assembly 10 to easily slide into frame assembly 12. Unfortunately, while clearance allows for easier insertion of module assembly 10 into frame assembly 12, such clearance also results in potential connector misalignment issues between the electrical connectors on module assembly 10 and the corresponding electrical connectors on frame assembly 12. Accordingly, adaptive connector assembly 14 may be configured to be displaceable in three axes.

Figure 5:
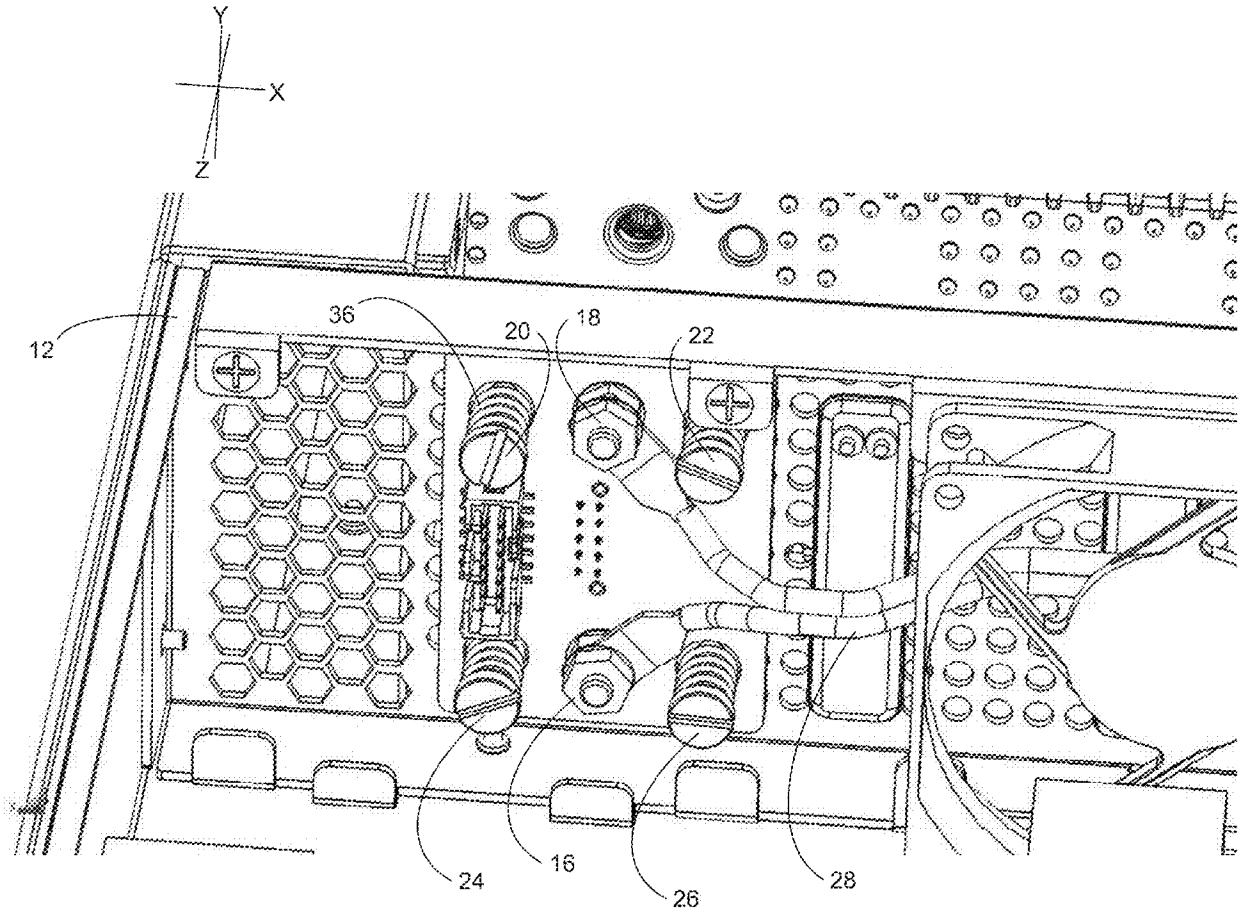
FIGS. 5-7 are detail views of the adaptive connector assembly of FIGS. 3-4.
Figure 6:
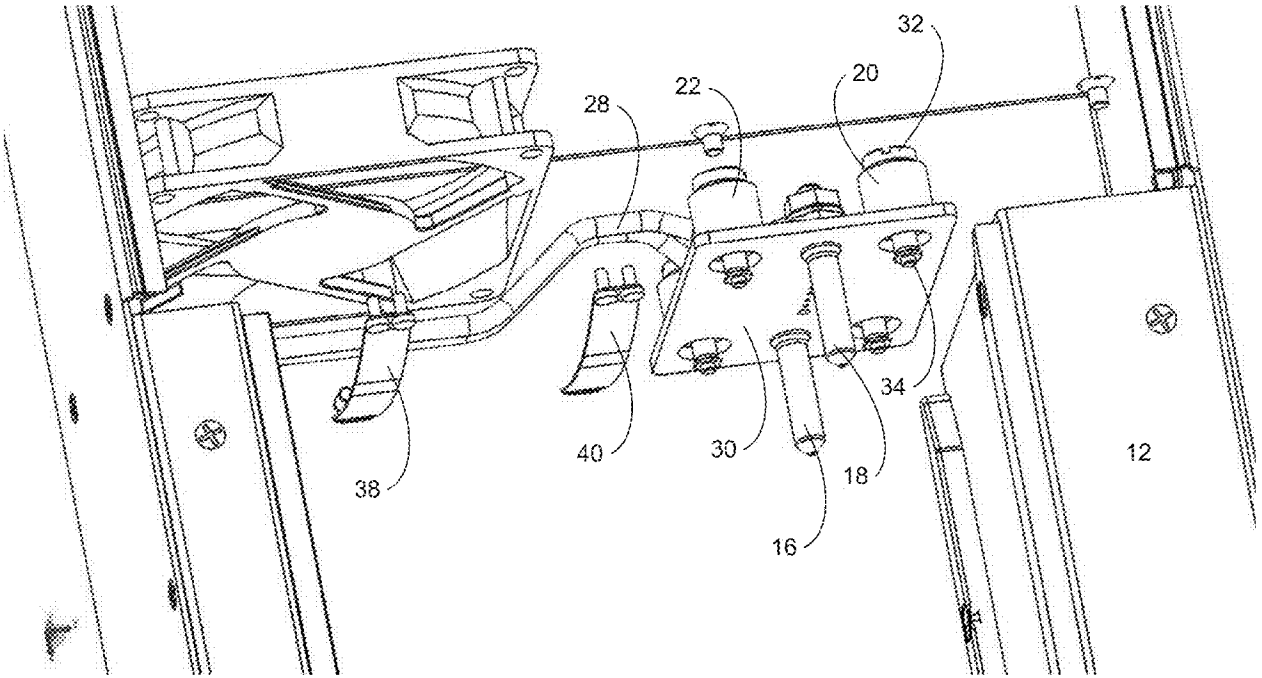
Figure 7:
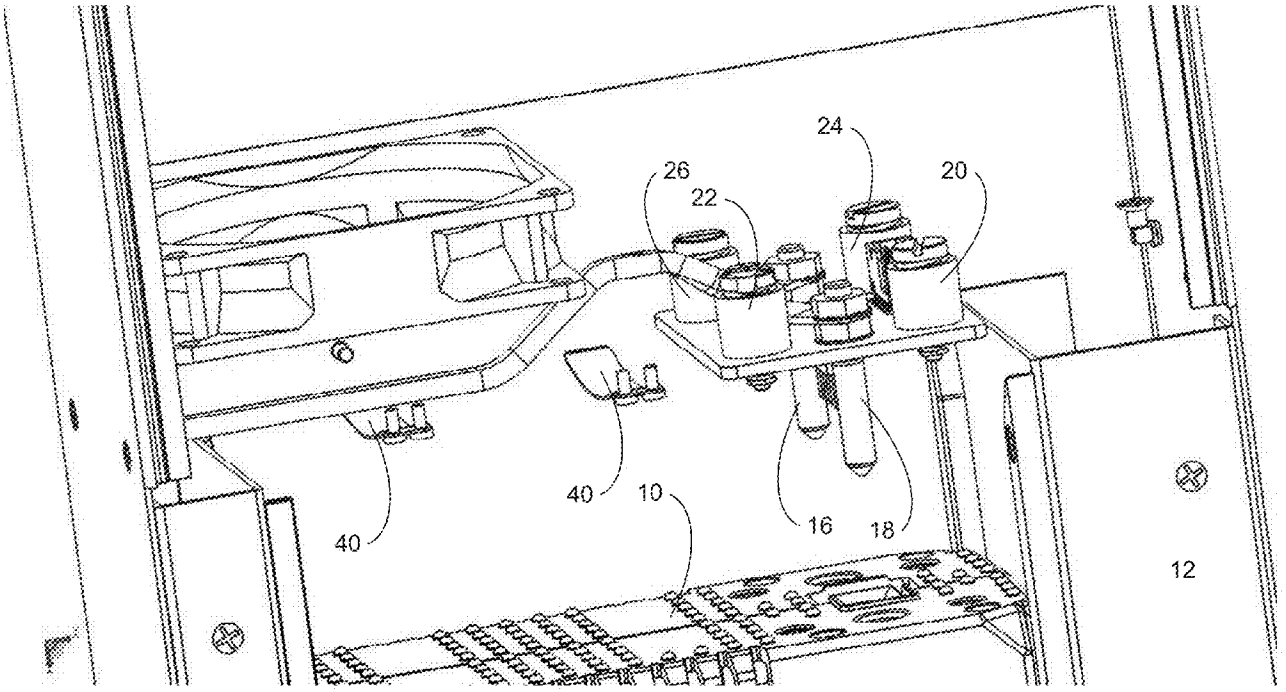

Referring also to FIGS. 5-7, there are shown more detailed views of adaptive connector assembly 14. Adaptive connector assembly 14 may include one or more compliance assemblies (compliance assemblies 20, 22, 24, 26) that allow for the movement of connector assembly 14 (and therefore pin assemblies 16, 18) in all three axes (as will be explained).

Adaptive connector assembly 14 may be provided with power by (in this embodiment) multi-conductor power cable 28 that (in this embodiment) provides power to pin connectors 16, 18. In this particular environment, pin connectors 16, 18 are attached to backplane 30, which is attached (via compliance assemblies 20, 22, 24, 26) to frame assembly 12. As shown in FIGS. 5-7, each compliance assembly includes (in this embodiment) screw portion 32, nut portion 34, and spring portion 36. While in this particular embodiment, compliance assembly 20 is shown to include screw portion 32, nut portion 34 and spring portion 36, this is for illustrative purposes only and is not intended to be a limitation of this disclosure, as other configurations are possible and it is the function of the compliance assembly that is more important than the actual components used to make the compliance assembly. In this particular example, the function of the combination of screw portion 32 and nut portion 34 is to capture spring portion 36 and provide a clamping force that biases backplane assembly 30 against frame assembly 12. Additionally, the hole in backplane assembly 30 through which screw portion 32 passes may be larger than the shank of screw portion 32 (while not as large as the diameter of spring portion 36). Accordingly, through the use of an oversized hole in backplane assembly 30 and/or an undersized screw portion 32, displacement of adaptive connector assembly 14 is achievable in the X axis and the Y-axis, as backplane assembly 30 may be displaced with respect to the screw portions of compliance assemblies 20, 22, 24, 26. Additionally, as spring portion 36 may be compressible in the Z-axis, adaptive connector assembly 14 may be displaceable in the Z-axis when adaptive connector assembly 14 comes in contact with module assembly 10.

One or more energy absorption assemblies 38, 40 may be positioned on frame assembly 12 so that when module assembly 10 is slid into frame assembly 12, energy absorption assemblies 38, 40 (which may be configured as leaf springs) absorb a portion of the impact energy of module assembly 10 striking the back of frame assembly 12.

Having thus described the disclosure of the present application in detail and by reference to embodiments thereof, it will be apparent that modifications and variations are possible without departing from the scope of the disclosure defined in the appended claims.

What is claimed is:

1. An adaptive connector assembly comprising:

two or more conductors; and at least one compliance member configured to allow for three dimensional movement of the two or more conductors with respect to a frame assembly, wherein the at least one compliance member includes a fastener assembly and a spring assembly, wherein the fastener assembly includes a screw portion and a nut portion to capture a spring portion associated with the spring assembly, wherein capturing the spring portion provides a clamping force to bias a backplane assembly against the frame assembly.

2. The adaptive connector assembly of claim 1 wherein the frame assembly is configured to be mounted within an information technology (IT) cabinet, wherein the IT cabinet includes at least one of a rack, a cabinet, and an enclosure.

3. The adaptive connector assembly of claim 1 wherein the frame assembly is configured to removeably couple a module assembly.

4. The adaptive connector assembly of claim 3 wherein the module assembly is an information technology (IT) module assembly, wherein the IT module assembly includes at least one of a hard disk drive module assembly, a processing module assembly, a power supply module assembly, and a controller module assembly.

5. The adaptive connector assembly of claim 1 wherein the two or more conductors include pin connectors.

6. The adaptive connector assembly of claim 5 wherein the pin connectors include at least one tapered end.

7. The adaptive connector assembly of claim 1 wherein the two or more conductors are attached to the backplane assembly.

8. The adaptive connector assembly of claim 1 wherein the fastener assembly is configured to pass through the backplane assembly.

9. The adaptive connector assembly of claim 1 further comprising one or more energy absorption assemblies attached to the frame assembly and configured to contact a module assembly when the module assembly is removeably coupled to the frame assembly.

10. An adaptive connector assembly comprising:

two or more conductors attached to a backplane; and at least one compliance member configured to allow for three dimensional movement of the two or more conductors with respect to a frame assembly, wherein the at least one compliance member includes a fastener assembly and a spring assembly, wherein the fastener assembly includes a screw portion and a nut portion to capture a spring portion associated with the spring assembly, wherein capturing the spring portion provides a clamping force to bias a backplane assembly against the frame assembly;

wherein the two or more conductors include pin connectors.

11. The adaptive connector assembly of claim 10 wherein the frame assembly is configured to removeably couple a module assembly.

12. The adaptive connector assembly of claim 11 wherein the module assembly is an information technology (IT) module assembly, wherein the IT module assembly includes at least one of a hard disk drive module assembly, a processing module assembly, a power supply module assembly, and a controller module assembly.

13. The adaptive connector assembly of claim 10 wherein the pin connectors include at least one tapered end.

14. The adaptive connector assembly of claim 10 wherein the fastener assembly is configured to pass through the backplane assembly.

15. An adaptive connector assembly comprising:

two or more conductors attached to a backplane assembly, wherein the two or more conductors include pin connectors; and two or more compliance members configured to allow for three dimensional movement of the backplane assembly with respect to a frame assembly, wherein the two or more compliance members include a fastener assembly and a spring assembly, wherein the fastener assembly includes a screw portion and a nut portion to capture a spring portion associated with the spring assembly, wherein capturing the spring portion provides a clamping force to bias a backplane assembly against the frame assembly.

16. The adaptive connector assembly of claim 15 wherein the pin connectors include at least one tapered end.

17. The adaptive connector assembly of claim 15 wherein the fastener assembly is configured to pass through the backplane assembly.

18. The adaptive connector assembly of claim 15 further comprising one or more energy absorption assemblies attached to the frame assembly and configured to contact a module assembly when the module assembly is removeably coupled to the frame assembly.

* * * * *